US008172915B2

(12) United States Patent
Mårtensson et al.

(10) Patent No.: US 8,172,915 B2
(45) Date of Patent: May 8, 2012

(54) METHOD OF MAKING A COMPOSITE DIAMOND BODY

(75) Inventors: Malin Mårtensson, Nacka (SE); Shirishkumar Bhosale, Pune (IN); Anand Goswami, Distr. Ratnagiri (IN); Shailesh Prabhune, Pune (IN)

(73) Assignee: Sandvik Intellectual Property AB, Sandviken, AB ( * ) Notice: Subject to any disclaimer, the term of this patent is extended or adjusted under 35 U.S.C. 154(b) by 505 days.

(21) Appl. No.: 12/467,576

(22) Filed: May 18, 2009

(65) Prior Publication Data

US 2009/0288348 A1 Nov. 26, 2009

(30) Foreign Application Priority Data

May 21, 2008 (SE) ..... 0801175

(51) Int. Cl.
*B24D 3/10* (2006.01)

(52) U.S. Cl. ..... 51/307; 51/293; 175/327

(58) Field of Classification Search ..... 51/293, 51/307; 175/327
See application file for complete search history.

(56) References Cited

U.S. PATENT DOCUMENTS

| | | | |
|---|---|---|---|
| 4,063,909 | A | 12/1977 | Mitchell |
| 4,403,015 | A | 9/1983 | Nakai et al. |
| 6,554,885 | B1 | 4/2003 | Mende et al. |
| 2005/0106057 | A1 | 5/2005 | Kamphuis et al. |

FOREIGN PATENT DOCUMENTS

| | | | | |
|---|---|---|---|---|
| EP | 1 033 414 | A2 | | 9/2000 |
| EP | 1033414 | A2 | * | 9/2000 |
| JP | 56-54278 | U | | 5/1981 |
| JP | 58-039764 | | * | 3/1983 |
| JP | 5-164693 | A | | 6/1993 |
| JP | 9-194978 | A | | 7/1997 |
| JP | 2000-246645 | A | | 9/2000 |
| JP | 2005336565 | | | 12/2005 |
| WO | 2008/053430 | | | 5/2008 |

OTHER PUBLICATIONS

European Search Report dated Jul. 29, 2009 issued in EP Application No. 09 16 0347.

Office Action from The State Intellectual Property Office of the People's Republic of China for Chinese Patent Application No. 200910138943.X, issued Jul. 14, 2010.

Notice of Reasons for Rejection against JP 2009-123329, dated Feb. 7, 2012.

* cited by examiner

*Primary Examiner* — Jerry Lorengo
*Assistant Examiner* — Jared Wood
(74) *Attorney, Agent, or Firm* — Morgan, Lewis & Bockius LLP

(57) ABSTRACT

The present invention relates to a method of producing a composite diamond body from powders of diamond particles and powders forming a binder phase comprising cobalt powder having mainly a fcc-structure and a grain size (FSSS) of from about 0.2 to about 2.9 μm., with a pressing and sintering operation. The present invention also relates to a composite diamond body made according to the method.

7 Claims, 2 Drawing Sheets

METHOD OF MAKING A COMPOSITE DIAMOND BODY

CROSS-REFERENCE TO PRIOR APPLICATION

This application claims priority to Swedish Application No. 0801175-1 filed May 21, 2008, which is incorporated by reference herein.

BACKGROUND OF THE INVENTION

The present invention relates to a method of producing a composite diamond body comprising the addition of diamond particles, and powder(s) forming the binder phase comprising cobalt, wherein the cobalt powder has mainly a face centered cubic (fcc) structure. The present invention also relates to a composite diamond body made according to the method of the invention.

Depending on composition and grain size, a wide range of diamond materials can be used in many applications, for instance in rock drilling, metal cutting tools and in wear parts. Examples of materials to be machined are concrete, metals, and natural stone such as granite, marble, sandstone, limestone, etc. Usually, due to its brittleness, composite diamond bodies are preferably placed onto a substrate with a higher toughness, for example cemented carbide or metal, often during the manufacturing of the composite diamond body.

The use of cobalt as a binder phase when manufacturing composite diamond bodies is well known in the art.

Cobalt is allotropic, that is, at temperatures less than about 417° C., pure cobalt atoms are arranged in a hexagonal close packed (hcp) structure and at temperatures above about 417° C., pure cobalt atoms are arranged in a face centered cubic (fcc) structure. Thus, above 417° C., pure cobalt exhibits an allotropic transformation, i.e., the hcp-structure changes to fcc-structure.

The cobalt powder conventionally used when manufacturing composite diamond bodies mainly has an hcp-structure. However, in a sintered body, the cobalt binder phase has an fcc-structure which is obtained during the sintering operation or the hot pressing operation.

During manufacturing of composite diamond bodies it is important that the cobalt powder is easily dispersed during mixing.

One of the important properties for composite diamond tool making is good pressing properties, i.e., the ability of achieve high density in the pressed body. Powders which are able to be pressed into bodies having high density will have less pores which is an advantage since pores can cause problems during machining.

It is also an advantage to have a high strength of the pressed body since it makes it less prone to crack or be deformed during handling.

A common phenomenon when making composite diamond bodies is that the hardness decreases when high sintering temperatures are used. A high sintering temperature is, for example, beneficial when tungsten carbide is added to improve the hardness and the wear properties.

Also, there is a constant need for improving the tool life of the composite diamond containing tools. Longer tool life is a great advantage in many applications since changing tools is a very time consuming step. An increased hardness of the composite diamond tool improves the tool life.

OBJECTS AND SUMMARY OF THE INVENTION

It is an object of the present invention to provide a method of making composite diamond bodies with improved pressing properties and an improved strength of the pressed body.

It is a further object of the present invention to provide a method of making a composite diamond body having an increased tool life.

It is yet a further object of the present invention to provide a method of making a composite diamond body where an increased sintering temperature can be used without a drop in hardness.

It is yet a further object of the present invention to provide a composite diamond body made according to the method of the invention.

In one aspect of the invention, there is provided a method of producing a composite diamond body comprises the steps of: providing powders of diamond particles and powder(s) forming a binder phase comprising cobalt powder and subjecting the powders of diamond particles and powder(s) forming a binder phase comprising cobalt powder to a pressing and sintering operation. The cobalt powder has a grain size, FSSS, of from about 0.2 to about 2.9 μm and comprises mainly cobalt having an fcc-structure with a peak height ratio Co-fcc (200)/Co-hcp(101) greater than or equal to about 1/2, where the peak height is measured between a baseline and a peak height maximum in an XRD pattern for the cobalt powder determined by XRD using a 2θ/θ focusing geometry and Cu—Kα radiation.

In another aspect of the invention, there is provided a product made by the above process.

DETAILED DESCRIPTION OF THE PREFERRED EMBODIMENTS OF THE INVENTION

Figure 1A:
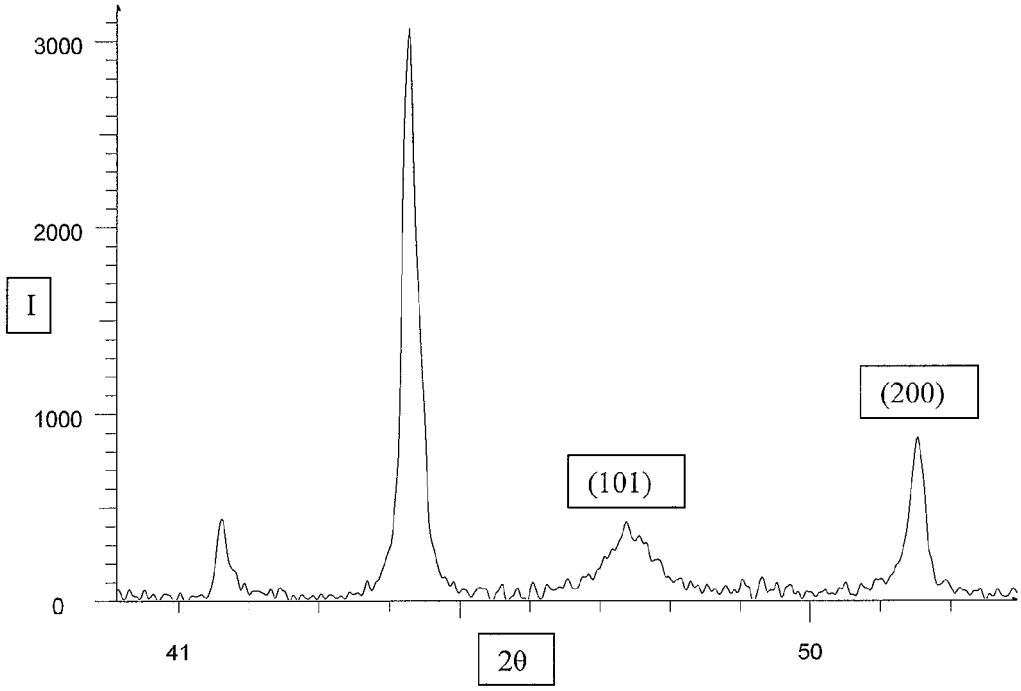
FIG. 1*a* shows the XRD pattern from an ultrafine cobalt powder according to the present invention characterized by a Co-fcc(200)/Co-hcp(101) ratio of 2.12. The powder has a Fischer grain size (FSSS) of 1.08 μm.
Figure 1B:
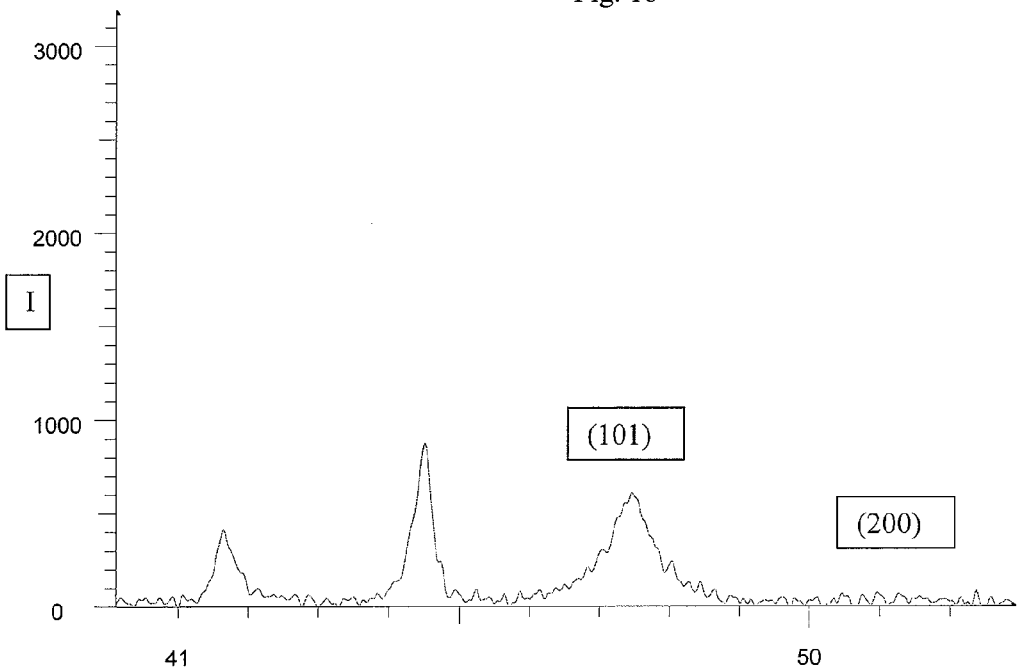
FIG. 1*b* shows the XRD pattern from a commercial ultrafine cobalt powder with a Co-fcc(200)/Co-hcp(101) ratio of 0.08 and an FSSS of 0.7 μm.
Figure 2A:
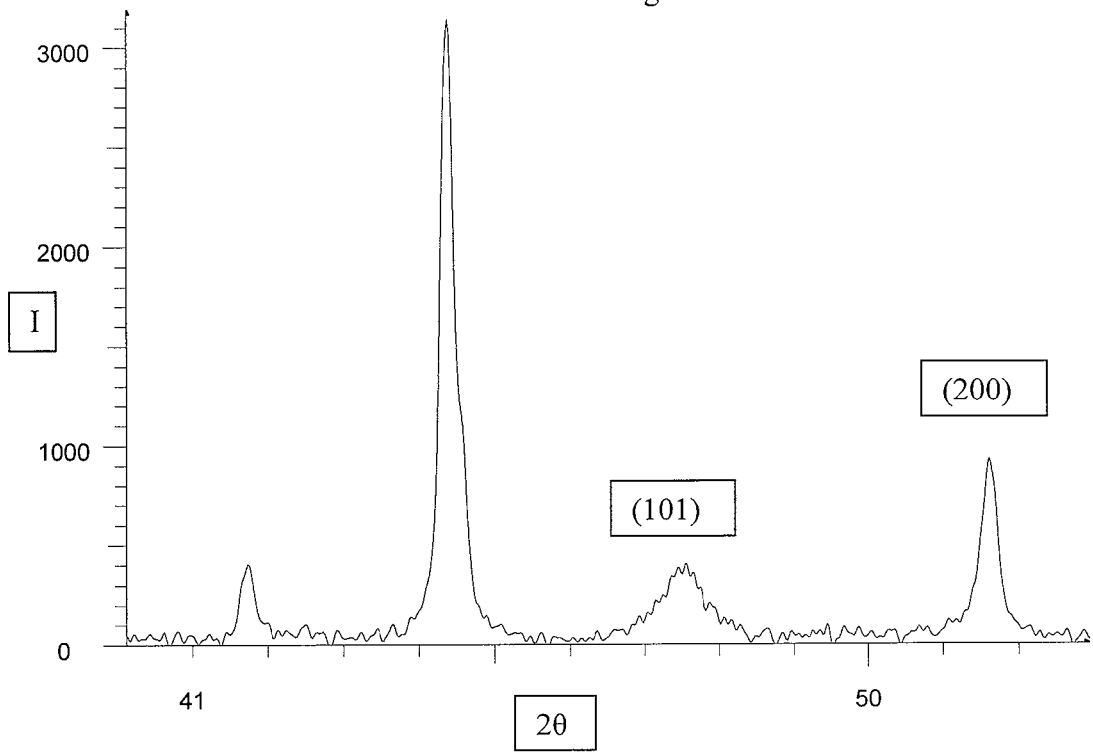
FIG. 2*a* shows the XRD pattern from a extrafine cobalt powder according to the present invention characterized by a Co-fcc(200)/Co-hcp(101) ratio of 2.24. The powder has a Fischer grain size (FSSS) of 1.45 μm.
Figure 2B:
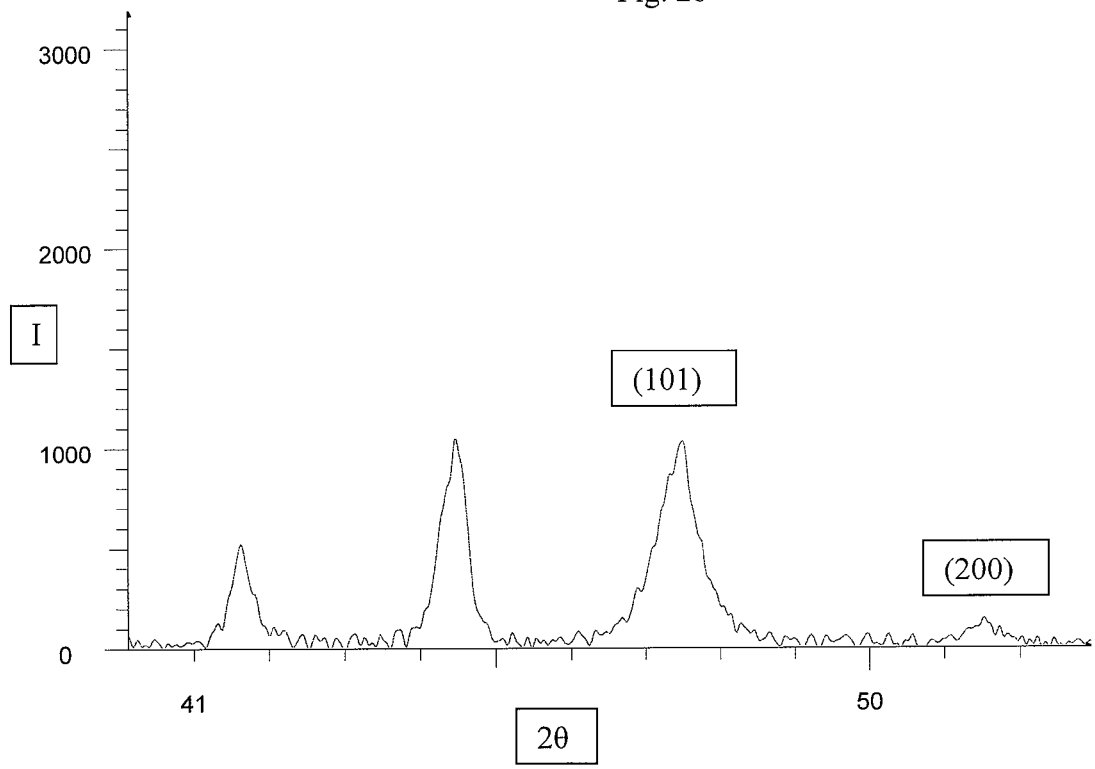
FIG. 2*b* shows the XRD pattern from a commercial extrafine cobalt powder with a Co-fcc(200)/Co-hcp(101) ratio of 0.14 and an FSSS of 1.4 μm.

It has now surprisingly been found that cobalt powders having mainly a fcc-structure can be used when manufacturing composite diamond bodies and that the use of such fcc-cobalt instead of cobalt mainly having an hcp-structure gives several advantages, both during the production of such composite diamond bodies as well as in the composite diamond body.

The method according to the present invention comprises the steps of:

- providing powders of diamond particles,
- providing powder(s) forming a binder phase comprising cobalt powder,
- subjecting the powders of diamond particles and powder(s) forming a binder phase comprising cobalt powder to a pressing and sintering operation.

The cobalt used in the process of the present invention has mainly a fcc-structure. The amount of cobalt having mainly fcc-structure is characterized by XRD and the identification is given from the structural information taken from the public PDF-database (Powder Diffraction File by the International Centre for Diffraction Data, ICDD) and represents the chemical compounds of interest i.e., fcc-cobalt (PDF 15-806) and hcp-cobalt (5-727). Additionally the Miller index of each metallic phase is given above each peak. At XRD measurements with a 2θ/θ focusing geometry and Cu—Kα radiation with subsequent background subtraction and $K\alpha_2$-stripping, the peak height ratio between the Co-fcc(200)/Co-hcp(101) being greater than or equal to about 1/2, preferably greater than or equal to about 2/3, more preferably greater than or equal to about 1 and most preferably greater than or equal to about 2, as measured between the baseline and maximum peak height for each peak. The maximum amount of fcc-cobalt is 100% for which the above mentioned peak height ratio→∞. The cobalt powder described above which is used in the method according to the present invention will hereinafter be referred to as "fcc-cobalt".

The cobalt powder used in the method according to the present invention preferably contains iron in an amount of less than about 1.5 wt %, preferably less than about 0.8 wt % and most preferably less than about 0.4 wt %. The cobalt powder further preferably contains at least about 100 ppm Mg, more preferably at least about 150 ppm Mg and most preferably about 200 up to about 500 ppm Mg. The ppm values are based on weight.

The cobalt powder can also contain other elements but in amounts corresponding to technical impurities, preferably below about 800 ppm, more preferably below about 700 ppm and most preferably below about 600 ppm.

The grain size of the cobalt powder, measured as FSSS (Fischer grain size), is preferably from about 0.2 to about 2.9 μm, more preferably from about 0.3 to about 2.0 μm and most preferably from about 0.4 to about 1.5 μm.

The mean particle size (d50) of the cobalt powder, measured with laser diffraction, is preferably from about 0.8 to about 5.9 μm, more preferably from about 0.8 to about 4.0 μm and most preferably from about 0.8 to about 3.0 μm.

The binder phase content in a composite diamond body greatly affects the properties of the composite body. Depending on which properties that are important for the specific application the amount of binder phase also varies. However, the amount of powder(s) forming a binder phase used in the method according to the present invention is preferably within the range of from about 70 to above about 99 wt % of the composite diamond body.

The powder(s) forming binder phase can, in addition to the fcc-cobalt powder, comprise other binder metals such as Ni, Fe, Cu, W and Sn or alloys thereof. Also other metals such as ruthenium, rhodium, palladium, chromium, manganese, tantalum, titanium, tungsten, tantalum carbides, other ceramic carbides and alloys and mixtures thereof also may be employed. Preferably the powder(s) forming binder phase comprises at least about 20 wt % Co.

The method according to the present invention can be applied to any conventional method of making composite diamond bodies. The powder(s) forming binder phase can be provided in various ways, for example by mixing the powder (s) forming binder phase with the powders of diamond particles, or as a separate layer of either powders or as a pre-pressed compact of binder phase material either below or on top of the powders of diamond particles. Binder phase can also be provided by a cemented carbide support from which the binder phase is allowed to penetrate the diamond powder during the pressing and sintering operation.

Preferably, the powders of diamond particles and the powder(s) forming the binder phase are placed onto a substrate surface and then subjected to a pressing and sintering operation, either as two separate steps or as a hot pressing operation. The substrate can be of different materials depending on the application. Examples are cemented carbide and tool steel.

The temperatures and pressures used during the method of making composite diamond tools vary within a wide range depending on the tool to be produced. For example, making composite diamond tools comprising fine grained diamond particles requires higher temperatures and pressures whereas composite diamond tools comprising more coarse grained diamond particles required lower temperatures and pressures.

In one embodiment of the present invention, composite diamond bodies are manufactured using diamond particles having a small grain sizes, for example, about 1 μm or less. Such tools can, for example, be used for machining metals like aluminum. The composite diamond bodies are preferably manufactured with a combined pressing and sintering operation which involves placing an unsintered mass of abrasive, crystalline diamond particles within a protectively shielded metal enclosure which is disposed within the reaction cell of a high temperature/high pressure (HT/HP) apparatus. Additionally placed in the enclosure with the abrasive diamond particles are powder(s) forming binder phase, as well as a pre-formed mass of a cemented metal carbide or any other suitable support material, for supporting the abrasive particles and to thereby form a supported compact. The contents of the cell then are subjected to processing conditions selected as sufficient to effect intercrystalline bonding between adjacent grains of the abrasive diamond particles and, optionally, the joining of the sintered particles to the cemented metal carbide support. The temperature and pressure for such a process step varies depending on the composition of the powders, the apparatus used, etc. The rates of the temperature and pressure increase/decrease can also be varied. Determining these parameters for each specific case are within the purview of the skilled artisan. However, preferably a temperature of at least about 1300° C. and a pressure of at least about 20 kbar is applied.

In another embodiment of the present invention, composite diamond bodies from diamond particles having a larger grain size are made. Such tools can for example be used for machining stone, etc. The specific grain size of the diamond particles depends on the application of the composite diamond tool, however typical grain sizes are in the range of from about 45 to about 1000 μm.

In one embodiment, composite diamond bodies from diamond particles having a larger grain size are made by preferably mixing the diamond particles and the powder(s) forming binder phase with a pressing agent, preferably paraffin oil. The mixture is then placed onto the surface of the substrate in a mold and preferably subjected to a cold pressing operation to form green segments. The green segments are then placed into a mold, preferably of graphite, in order to be hot pressed. The hot pressing operation is performed in several steps, preferably by stepwise increasing the temperature and pressure. The parameters for this operation depend on the material chosen and the equipment used and is preferably chosen by a person skilled in the art. However, a typical temperature range for the maximum temperature is from about 850 to about 950° C. In one embodiment of the present invention, the sintering temperature is above about 900° C. The temperature increase can vary between different steps in the hot pressing operation. Also, the holding time at the temperature specific for each step in the pressing operation can vary from zero seconds up to about several hundred seconds. The pressing pressure is also increased during the hot pressing operation together with the temperature and the maximum pressure that is reached during the final step is preferably between from about 200 to about 500 kg/cm$^2$.

The amount of diamond particles in the composite diamond body made according to the present invention depends on the application of the tool. However, the diamond content in the composite diamond body is preferably at least about 70% by volume.

Also, other compounds commonly used in the making of composite diamond bodies can be added in the method according to the present invention. Examples of such additives are secondary abrasives like WC, SiC, and fine grained diamond powder or solid lubricants like silver, graphite and hexagonal boron nitride.

The composite diamond body, preferably together with the supporting substrate, is then cut into pieces of different shapes depending on the application of the composite diamond body. Usually the composite diamond bodies are brazed to a substrate or holder which can be used as round tools, cutting tool inserts, wear parts, rollers, rock drilling tools, saw blades, etc.

The present invention also relates to a composite diamond body made according to the method disclosed herein. The composite diamond body comprises diamond particles and a binder phase comprising cobalt which prior to compaction and sintering mainly has an fcc-structure characterized by XRD as described above. The binder phase content in the composite diamond body varies significantly depending on the application but is preferably from about 70 to above about 99 wt % of the composite diamond body.

The composite bodies according to the present invention can be used in many applications. Usually the composite diamond bodies are brazed to a substrate or holder which can be used as round tools, cutting tool inserts, wear parts, rollers, rock drilling tools, saw blades etc.

The invention is additionally illustrated in connection with the following examples, which are to be considered as illustrative of the present invention. It should be understood, however, that the invention is not limited to the specific details of the examples.

Example 1

One way to evaluate the effect of sintering temperature on hardness of composite diamond bodies is to measure the hardness of sintered bodies of pure cobalt at different sintering temperatures.

Fcc-cobalt powder according to the present invention with an FSSS grain size of 0.95 μm, a magnesium content of 0.02 wt % and with a peak height ratio between the Co-fcc(200)/Co-hcp(101) of 3/2. The peak height ratio was measured between the baseline and maximum peak height, measured by XRD with a 2θ/θ focusing geometry and Cu—Kα radiation.

The cobalt powder was placed in a mold. The powder was then pressed using a pressure of 4500 Kgf/cm$^2$. The pressed powder was then placed in a carbon mold and was then sintered at a sintering pressure of 350 Kgf/cm$^2$. The sintering temperature was varied according to Table 1. The sintering was, for all runs, starting at 540° C. for 2 minutes. After that, the temperature was increased until the desired temperature was reached. That temperature was then kept for a specific holding time. The sintering temperatures and the holding time at the final sintering temperature are shown in Table 1.

For comparison, sintered cobalt bodies were prepared according to the above but by using commercial cobalt grades, intended for the same use, all having mainly an hcp-structure.

TABLE 1

| Sintering temperature | 750° C. | 800° C. | 850° C. | 900° C. | 950° C. |
|---|---|---|---|---|---|
| Sintering time | 4 min, 20 sec | 4 min, 50 sec | 5 min, 20 sec | 6 min | 6 min, 30 sec |

The hardness was then measured by an Hardness Testing Machine on the HRB scale with a cemented carbide ball. Each value is an average of 9 measurements. The results are shown in Table 2.

TABLE 2

| Cobalt quality | 750° C. | 800° C. | 850° C. | 900° C. | 950° C. |
|---|---|---|---|---|---|
| fcc-cobalt | 101.6 | 103.7 | 102.8 | 103.7 | 103.2 |
| Commercial 1 | 99.2 | 97.0 | 97.9 | 94.1 | 93.4 |
| Commercial 2 | 102.9 | 103.8 | 104.9 | 102.1 | 94.4 |
| Commercial 3 | 100.0 | 103.1 | 102.3 | 100.7 | 94.7 |
| Commercial 4 | 101.0 | 101.3 | 97.8 | 94.2 | 93.2 |

As can be seen in Table 2, cobalt bodies according to the present invention shows no drop in hardness at higher sintering pressures compared to cobalt bodies made with commercial cobalt grades.

Example 2

Sintered cobalt bodies were also prepared using free sintering at a sintering temperature of 900° C. Bodies according to the present invention was prepared from fcc-cobalt powder with an FSSS grain size of 0.95 μm, a magnesium content of 0.02 wt % and with a peak height ratio between the Co-fcc (200)/Co-hcp(101) of 3/2. The peak height ratio was measured between the baseline and maximum peak height, measured by XRD with a 2θ/θ focusing geometry and Cu—Kα radiation.

For comparison, sintered cobalt bodies were also prepared in the same way as described above but by using four different commercial cobalt grades, all having mainly an hcp-structure. The hardness was measured in the same way as in Example 3.

TABLE 3

| | Cobalt quality | | | | |
|---|---|---|---|---|---|
| | fcc-cobalt | Commercial 1 | Commercial 2 | Commercial 3 | Commercial 4 |
| HRB | 101.9 | 91.0 | 96.7 | 92.0 | 89.7 |

As can be seen in Table 3, sintered cobalt bodies according to the present invention shows a higher hardness at 900° C. compared to the sintered cobalt bodies made with commercial cobalt grades.

Example 3

The pressing properties and the strength of the pressed body were investigated for powder mixtures of diamond particles and cobalt.

Three different powder mixtures were prepared from 95.95 wt % Co, 2.56 wt % diamond particles and 1.5 wt % paraffin. First 14.394 g Co and 0.22 g paraffin was carefully ground in an agate mortar, then it was thoroughly mixed with 0.384 g diamond particles. Two cobalt qualities was tested, see table 1.

TABLE 4

| Powder No. | Cobalt quality | Grain size, μm (FSSS) | Co-fcc(200)/ Co-hcp(101) |
|---|---|---|---|
| 1 | Invention | 1.0 | 2/3 |
| 2 | Ref. 1 | 0.9 | 1/10 |

The powder density was analyzed for the powder mixtures, then the powder mixtures were pressed into green bodies to maximum pressure, Pmax, of first 50 MPa and the to a Pmax of 100 MPa. The diameter of the die was 9.525 mm. The density was determined based on the dies position, i.e., the height of the green body, after reaching each maximum pressure. The results can be seen in Table 5.

TABLE 5

| Powder No. | Powder density, ($g/cm^3$) | Density green body at Pmax 50 MPa, ($g/cm^3$) | Density green body at Pmax 100 MPa, ($g/cm^3$) |
|---|---|---|---|
| 1 | 1.19 | 4.12 | 4.54 |
| 2 | 1.30 | 3.91 | 4.24 |

The axial strength of the green bodies was also measured and it is the maximum crushing pressure registered during compact crushing along the axial (parallel to pressing) direction. This is the green strength responsible for holding the compact together during ejection from a die. The results can be seen in Table 6.

TABLE 6

| Powder No. | Axial strength (MPa) at Pmax 50 MPa | Axial strength (MPa) at Pmax 100 MPa |
|---|---|---|
| 1 | 2.4 | 8.8 |
| 2 | 1.3 | 3.6 |

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. Method of producing a composite diamond body comprising the steps of:

providing powders of diamond particles, providing powder(s) forming a binder phase comprising cobalt powder, subjecting the powders of diamond particles and powder(s) forming a binder phase comprising cobalt powder to a pressing and sintering operation, wherein the cobalt powder has a grain size, FSSS, of from about 0.2 to about 2.9 μm and comprises mainly cobalt having an fcc-structure with a peak height ratio Co-fcc(200)/Co-hcp (101) greater than or equal to about 1/2, where the peak height is measured between a baseline and a peak height maximum in an XRD pattern for the cobalt powder determined by XRD using a 2θ/θ focusing geometry and Cu—Kα radiation.

2. A method of claim 1 wherein the peak height ratio between the Co-fcc(200)/Co-hcp(101) being greater than or equal to about 2/3.

3. A method of claim 1 wherein the peak height ratio between the Co-fcc(200)/Co-hcp(101) is greater than or equal to about 1.

4. A method of claim 1 wherein the amount of added powder(s) forming binder phase is from about 70 to above about 99 wt %.

5. A method of claim 1 wherein the cobalt powder contains at least about 100 ppm Mg.

6. A sintered body made by the method of claim 1.

7. A sintered body of claim 6 wherein the binder phase content is from about 70 to above about 99 wt %.

* * * * *